United States Patent [19]

Adamson et al.

[11] 3,988,872

[45] Nov. 2, 1976

[54] PORTABLE BUILDING FRAME CONNECTOR

[75] Inventors: Harold C. Adamson, Sayville; George Spector, New York, both of N.Y.

[73] Assignee: Harold C. Adamson, Sayville, N.Y.

[22] Filed: Apr. 23, 1974

[21] Appl. No.: 463,304

[52] U.S. Cl. ..... 52/752; 403/405; 403/217

[51] Int. Cl.[2] ..... F16B 7/04

[58] Field of Search ..... 403/231, 232, 219, 191, 403/217, 219, 170, 171, 172, 405; 52/751, 752, 753 R, 753 C, 753 D, 47, 48, 51, 54

[56] References Cited

UNITED STATES PATENTS

| | | | |
|---|---|---|---|
| 1,995,668 | 3/1935 | Clark | 403/235 |
| 2,037,736 | 4/1936 | Payne et al. | 403/406 X |
| 2,723,107 | 11/1955 | Parker | 52/753 R UX |
| 2,788,011 | 4/1957 | Turner | 135/4 R |
| 2,839,320 | 6/1958 | Hill | 135/DIG. 9 |
| 2,874,708 | 2/1959 | Daus | 403/172 X |
| 2,931,129 | 4/1960 | Boniface | 403/171 X |
| 3,184,800 | 5/1965 | Nelson | 403/402 X |
| 3,386,590 | 6/1968 | Gretz | 403/172 X |
| 3,740,084 | 6/1973 | Tellberg | 403/171 |

FOREIGN PATENTS OR APPLICATIONS

| | | | |
|---|---|---|---|
| 537,965 | 3/1957 | Canada | 182/185 |
| 1,295,797 | 5/1962 | France | 403/171 |
| 729,692 | 12/1942 | Germany | 403/170 |
| 131,761 | 5/1951 | Sweden | 52/752 |

*Primary Examiner*—Wayne L. Shedd
*Attorney, Agent, or Firm*—Stanley Ira Laughlin

[57] ABSTRACT

A truss-like apparatus to provide structural connection of wooden members in the erection of shelters comprising a complementary pair of tiebeam and kingpost members, fastening means for the truss members, and means for clamping said wooden members when said truss members are fastened together.

4 Claims, 13 Drawing Figures

Fig. 4
Fig. 1
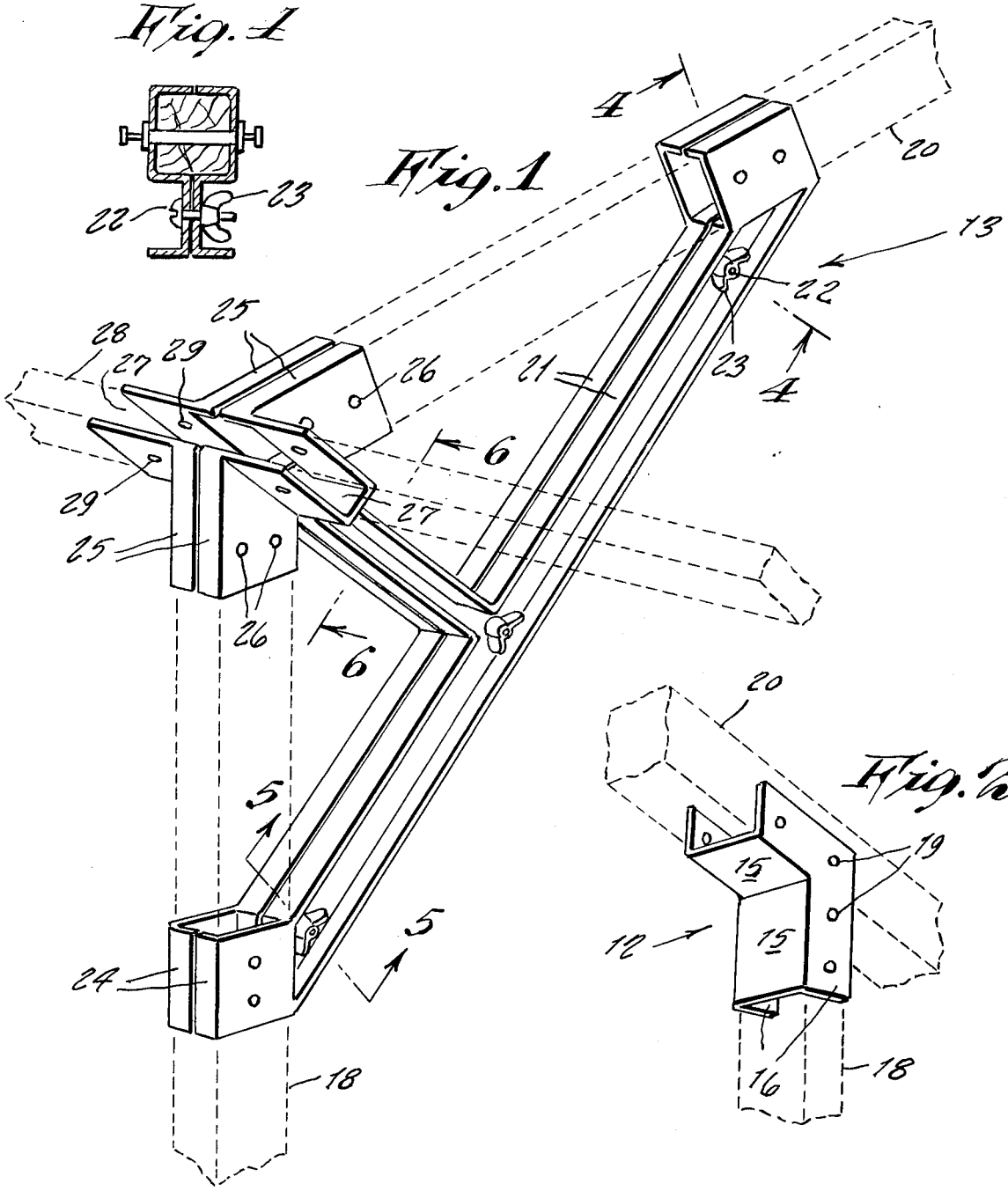
Fig. 2
Fig. 6
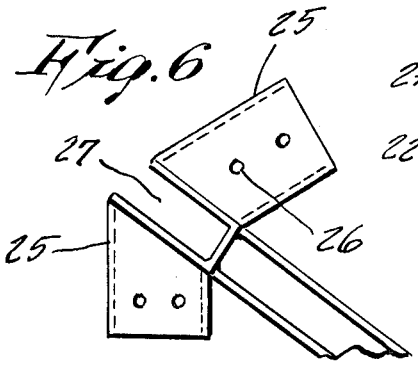
Fig. 5
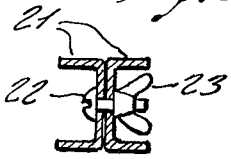
Fig. 3
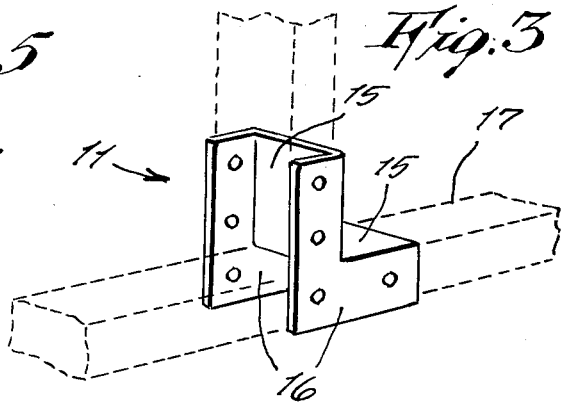

Fig. 7
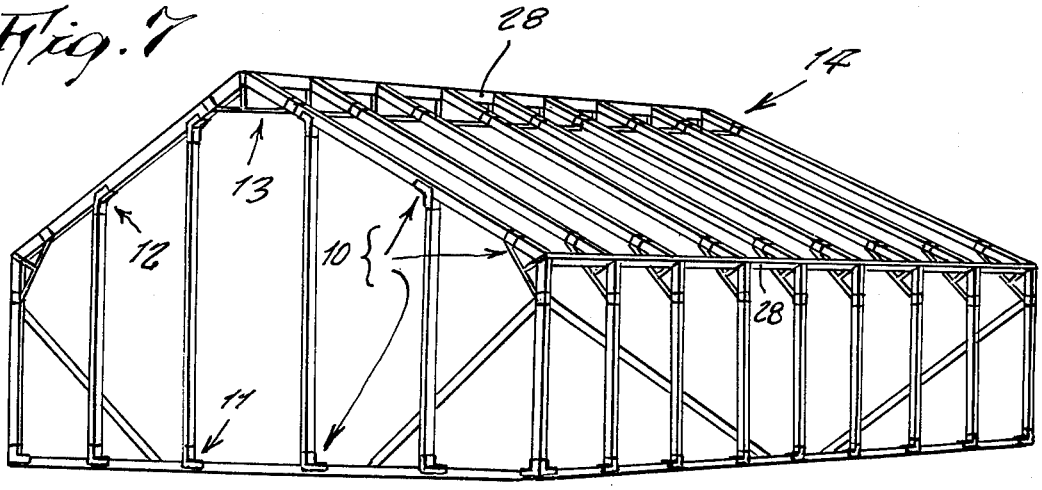
Fig. 8
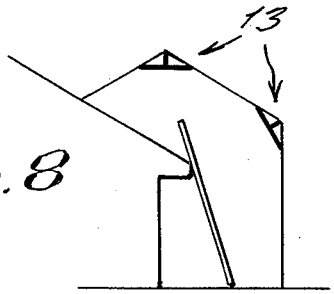
Fig. 9
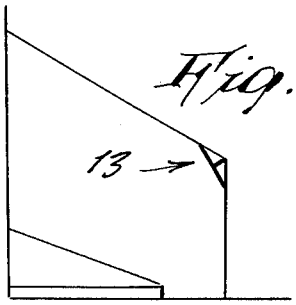
Fig. 10
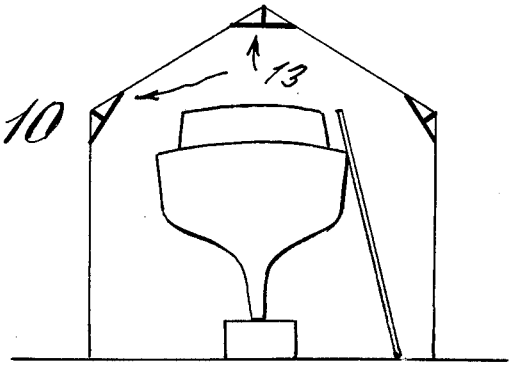
Fig. 11
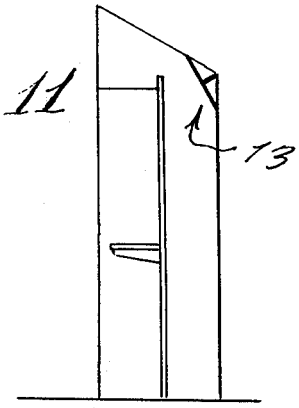
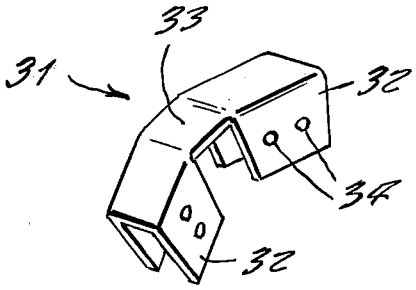
Fig. 12
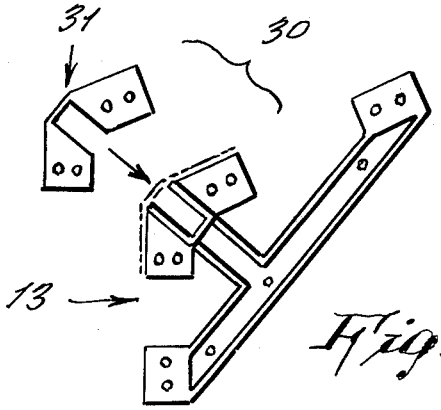
Fig. 13

PORTABLE BUILDING FRAME CONNECTOR

This invention relates generally to building structural devices.

A principle object of the present invention is to provide temporary structural means which will quickly and easily make strong, rigid connections between ridge and eave wood beam members in the construction of a temporary shelter.

Another object is to provide temporary structural means which require the workman to have only a hand saw and a claw hammer.

Another object is to provide temporary structural means which permit the shelter to be quickly and easily disassembled for storage or reassembly again in another location.

Still another object is to provide temporary structural means which would find many uses in industry, the home, or on a farm.

Other objects are to provide a portable building frame connector which is simple in design, inexpensive to manufacture, rugged in construction, easy to use and efficient in operation.

These and other objects will be readily evident upon a study of the following specification and the accompanying drawings wherein:

FIG. 1 is a perspective view of the eave and ridge connector.

FIG. 2 is a perspective view of the end wall roof arm connector.

FIG. 3 is a perspective view of the base connector.

FIG. 4 is a cross section on line 4—4 of FIG. 1.

FIG. 5 is a cross section on line 5—5 of FIG. 1.

FIG. 6 is a view in direction 6—6 of FIG. 1.

FIG. 7 is a perspective view of a shelter frame showing the present invention incorporated in its construction.

FIGS. 8, 9, 10 and 11 show various, different uses of the connectors.

Referring now to the drawing in detail and more particularly to FIGS. 1 to 11 at this time, the reference numeral 10 represents conventional portable building frame connectors comprising base connector 11 shown in FIG. 2 and, end wall roof arm connectors 12 shown in FIG. 3. Applicant's invention, as shown in FIG. 1 relates to a truss-like eave and ridge connector 13, and can be used along with conventional portable building frame connectors in the erection of a frame for a temporary shelter as shown as reference 14 in FIG. 7.

The wooden members comprise standard lumber that is available in any lumber yard. The members are square cut to length only, and no angle cuts are required.

Since in the example shown the roof pitch is 30 degrees, the angles formed by the eaves and ridge are identical. Thus the connector 13 can be used at either place. Wall height, roof arm length and frame spacing can be varied to suit the individuals requirements within the limits set forth by the manufacturer based on safe loadings of wood members. Safe limits for span, wall height, and frame spacing should be included in the assembly instructions packed with each type of connector 11, 12 and 13.

The base connector 11 shown in FIG. 3 is L-shaped with legs 15 at right angle, and has parallel, spaced apart flanges 16 for horizontal base beam 17 and vertical wall stud 18 fitting therebetween and being secured by nails received through openings 19 in the flanges. The end wall roof arm connector 12, shown in FIG. 2 is identical to connector 11 except that the legs 15 are at an obtuse angle respective to each other so to secure inclined roof arms 20 to studs 18.

The inverted tee connector 13, shown in FIGS. 1, 4, 5 and 6 is comprised of two complementary three legged channel members 21 which are bolted together by bolts 22 fitted with wing nuts 23 after being positioned on opposite sides of wall studs 18 and roof arms 20, and which are clamped within U-shaped half boxes or clamps 24 and 25 formed on each terminal of member 21. Half boxes 24 grasp intermediate portions of the studs and arms, which half boxes 25 grasps the ends thereof. Nail holes 26 in the half boxes receive nails to lock the wooden members 18 and 20 to the connector. It is to be noted that a transverse channel or half box 27 is formed between half boxes 25 so to receive horizontal eaves or ridge wooden beams 28, and which is secured in the channel by nails received through nail holes 29.

FIGS. 8 to 11 show connector 13 (or connector 30) used in other constructions. FIG. 8 shows roof and wall enclosure over-roof structure. FIG. 9 shows a wall and ground enclosure installation. FIG. 10 shows a boat enclosure structure. FIG. 11 shows a high wall enclosure structure.

Erection procedure is as follows:

1. Layout base to size required.
2. Assemble type 13 connector.
3. Insert precut wall and roof arm members and nail.
4. Locate Type 11 connector at frame spacing.
5. Raise assembled end frame and temporarily brace.
6. Erect remaining frames and brace together.
7. Install eave and ridge members and nail.
8. Locate type 12 connectors on roof arm and nail in place.
9. Locate type 11 connectors on base and nail in place.
10. Install end wall members and brace as desired.
11. Cover entire structure with plastic sheet, staple to eave, base and end wall members.
12. Add doors and any other additional construction.

The connectors may be sold in hardware stores, lumber yards, home improvement centers, mail order houses and department stores. Packaging would be as follows:

a. Frame Kit.
3 Type 13 connectors
2 Type 12 connectors
60 Double Headed 6d nails
12 Machine screws, wing nuts and lock washers.
b. End Wall Kit.
1 Type 11 connector
1 Type 12 connector per end wall member
16 Double Headed 6d nails
Bracing member hardware not included.

Plastic sheet covering and wood frame members are all available at any lumber yard.

While various changes may be made in the detail construction, it is understood that such changes will be within the spirit and scope of the present invention as is defined by the appended claims.

What is claimed is:

1. Apparatus to provide the structural connection of a plurality of wooden members in the erection of shelters comprising a pair of identical three legged channel members having the shapes of inverted tees, complementary U-shaped clamps formed at oblique angles on opposite ends of two legs of said channel members, complementary combination U-shaped clamps formed at the ends of corresponding third legs of said channel members, and means for fastening the complementary bases of said channel members to rigidly clamp and position each of said plurality of wooden members by said complementary combination U-shaped clamps and at least two of said plurality of wooden members by means of said complementary U-shaped clamps.

2. Apparatus as claimed in claim 1 further comprising means for fastening said U-shaped clamps to said wooden members.

3. Apparatus as claimed in claim 1 wherein said identical three legged channel members essentially consist of metals.

4. Apparatus as claimed in claim 1 wherein said identical three legged channel members essentially consist of plastic.

* * * * *